US007097514B2

(12) United States Patent
Ishizaki et al.

(10) Patent No.: US 7,097,514 B2
(45) Date of Patent: Aug. 29, 2006

(54) FEMALE-MALE CONNECTOR FITTING STRUCTURE

(75) Inventors: Kazuhisa Ishizaki, Haibara-gun (JP); Eiji Aoki, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/191,923

(22) Filed: Jul. 29, 2005

(65) Prior Publication Data

US 2006/0025021 A1 Feb. 2, 2006

(30) Foreign Application Priority Data

Jul. 30, 2004 (JP) ..... P2004-223196

(51) Int. Cl.
*H01R 13/64* (2006.01)

(52) U.S. Cl. ..... 439/681

(58) Field of Classification Search ..... 439/681, 439/677, 680

See application file for complete search history.

(56) References Cited

U.S. PATENT DOCUMENTS 4,159,862 A * 7/1979 Funck et al. ..... 439/681
4,938,718 A * 7/1990 Guendel ..... 439/680

FOREIGN PATENT DOCUMENTS

JP 2002-117947 A 4/2002

* cited by examiner

*Primary Examiner*—Ross Gushi
(74) *Attorney, Agent, or Firm*—Sughrue Mion, PLLC

(57) ABSTRACT

In a structure of fitting female and male connectors together, the female connector includes a female housing, and a female adapter which is provided on the female housing, and has a guide groove, and is fitted on a fitting portion provided at the male connector. The male connector includes a guide rib which is formed at the fitting portion, and is engageable in the guide groove. The female adapter can be rotated relative to the female housing to be placed at any of a plurality predetermined angular positions arranged with a fixed interval, and can be attached to the female housing. Only when the female adapter is rotated into a preselected one of the plurality predetermined angular positions, and is attached to the female housing of the female connector, the guide rib can be fitted in the guide groove, thereby allowing the female and male connectors to be fitted together.

8 Claims, 8 Drawing Sheets

FEMALE-MALE CONNECTOR FITTING STRUCTURE

BACKGROUND OF THE INVENTION

This invention relates to a structure of fitting female and male connectors together.

Female and male connectors have been used for electrically connecting a wire (or cable) to an electrical equipment or a wire, and in order to prevent the erroneous fitting of the two connectors, there has been used the type of female and male connectors, in which a guide groove is formed in a connector housing of the female connector, and a guide rib for engagement in the guide groove is formed on a connector housing of the male connector (see, for example, JP-A-2002-117947).

As shown in FIGS. 7A, 7B and 8, the male connector 102 and female connector 103, disclosed in Patent Literature 1, are shield connectors which are used for connecting a shielded wire (or cable) 109 to an electrical equipment or the like, and are mounted on an automobile.

The male connector 102 includes an inner housing 121 made of an insulative synthetic resin, and an outer housing 104 which is made of an electrically-conductive non-magnetic material, and is formed integrally with the inner housing 121. The inner housing 121 is formed into a generally hollow cylindrical shape, and a pin-shaped male terminal 143 is received and held at its intermediate portion (in its longitudinal direction) in an internal space of the inner housing 121. The outer housing 104 is formed into a generally hollow cylindrical shape, and covers the inner housing 121 and an electrical contact portion 142 which is formed at a distal end of the male terminal 143 and projects outwardly from the inner housing 121 in surrounding relation thereto. An engagement projection 144 for fixing the female connector 103 is formed on an outer peripheral surface of the outer housing 104, and also a guide rib 174 is formed on this outer peripheral surface, and extends from an open end of the outer housing 104 in a fitting direction in which the male connector 102 and the female connector 103 are fitted together.

The female connector 103 includes an inner housing 114 and an outer housing 115 which are formed integrally with each other, using an insulative synthetic resin. The inner housing 114 is formed into a generally hollow cylindrical shape, and a female terminal 122, electrically connected to a conductor 126 of the shielded wire 109, is received and held in an internal space of the inner housing 114. The outer housing 115 includes a tubular portion 116 placed close to an outer periphery of a rear end portion of the inner housing 114, and a hood portion 117 of a generally hollow cylindrical shape covering a front end portion of the tubular portion 116 and a front end portion of the inner housing 114. A lock arm 139 for fixing the male connector 102 is formed within a rear end portion of the hood portion 117. A guide groove 140 is formed in an inner surface of a front end portion of the hood portion 117, and extends from an open end of the hood portion 117 in the fitting direction.

When the male connector 102 and the female connector 103 are fitted together, with the outer housing 104 of the male connector 102 inserted in the hood portion 117 of the female connector 103, the engagement projection 144 of the male connector 102 is engaged with the lock arm 139 of the female connector 103, thereby fixing the male and female connectors 102 and 103 to each other.

The guide rib 174 of the male connector 102 and the guide groove 140 of the female connector 103 are so placed as to correspond to each other, and with this arrangement the outer housing 104 of the male connector 102 can be inserted into the hood portion 117 of the female connector 103, thus allowing the male connector 102 and the female connector 103 to be fitted together. Namely, the guide rib 174 of the male connector 102 and the guide groove 140 of the female connector 103 prevent the erroneous fitting of the male and female connectors 102 and 103.

Incidentally, in the case where there are a plurality of mating pairs of female and male connectors of the above construction, the positions of the guide rib and guide groove are usually changed from one mating pair of connectors to another mating pair so that the mating pair of female and male connectors can be easily recognized, that is to say, the male connector will not be erroneously fitted into the female connector which is not its mate.

However, in order to change the positions of the guide rib and guide groove from one mating pair of connectors to another mating pair, it has been necessary to exchange molds (for respectively forming the guide rib and the guide groove at different positions) in the injection molding of the female and male connectors. Therefore, in the case where a plurality of pairs of female and male connectors are provided, it has been necessary to prepare the same number of molds as the number of the pairs of female and male connectors. And besides, considerable time and labor have been required for exchanging the mold, and therefore it has been necessary to take measures to reduce the production cost of the female and male connectors.

SUMMARY OF THE INVENTION

This invention has been made in view of the above circumstances, and an object of the invention is to provide a female-male connector-fitting structure in which a mating pair of female and male connectors can be easily recognized, thereby preventing the erroneous fitting of the female and male connectors, and also the production cost can be reduced.

The above object has been achieved by a female-male connector-fitting structure of the present invention having the following arrangement, (1) A connector comprising:

a first housing adapted to be fitted with a second housing along a fitting axis; and a adapter provided on the first housing so as to be rotatable relative to the first housing about the fitting axis, the adapter provided with a first fitting member that is adapted to be fitted with a second fitting member provided in the second housing, so that the first fitting member is selectably placed in one of a plurality of predetermined angular positions relative to the fitting axis in accordance with the rotation of the adapter.

(2) A connector according to (1), wherein the plurality of predetermined angular positions are arranged with a fixed interval.

(3) A connector according to (2), wherein the first housing includes a first mounting hole that has a regular polygonal shape, the adapter is formed with a first mounting portion corresponding to the first mounting hole, and the first mounting portion is fitted with the first mounting hole.

(4) A connector according to (1), wherein one of the first and second fitting members is a groove extending in a direction of the fitting axis, and the other fitting member is a convex portion corresponding to the groove.

(5) A structure comprising:

a plurality of connectors, each of which comprises:

a first housing and a second housing adapted to be fitted with each other along a fitting axis; and a first adapter provided on the first housing so as to be rotatable relative to the first housing about the fitting axis, the first adapter provided with a first fitting member that is adapted to be fitted with a second fitting member provided in the second housing, so that the first fitting member is selectably placed in one of a plurality of predetermined angular positions relative to the fitting axis in accordance with the rotation of the first adapter, wherein the predetermined angular positions of the first fitting members in at least two of the connectors are different from each other.

(6) A structure according to (5), wherein the second housing is provided with a second adapter having the second fitting member, and provided on the second housing so as to be rotatable relative to the second housing about the fitting axis.

(7) A structure according to (6), wherein the second housing includes a second mounting hole that has a regular polygonal shape, the second adapter is formed with a second mounting portion corresponding to the second mounting hole, and the second mounting portion is fitted with the second mounting hole.

(8) A method of fitting connectors comprising:

providing a plurality of connectors, each of which comprises:

a first housing and a second housing adapted to be fitted with each other along a fitting axis; and a first adapter provided on the first housing so as to be rotatable relative to the first housing about the fitting axis, the first adapter provided with a first fitting member that is adapted to be fitted with a second fitting member provided in the second housing, so that the first fitting member is selectably placed in one of a plurality of predetermined angular positions relative to the fitting axis in accordance with the rotation of the first adapter;

placing the second housings such that angular positions of the second fitting members relative to the fitting axis in at least two of the connectors are different from each other;

rotating the first adapters such that the angular positions of the first fitting members correspond to the angular positions of the second fitting members, respectively; and fitting the first fitting members with the second fitting members, respectively.

According to the present invention, so that the first fitting member is rotated into a position corresponding to the second fitting member (that is, a position where the first fitting member can be engaged with the second fitting member) Therefore, by using the common first adapter, there can be provided the plurality of kinds of first connectors and a plurality of kinds of second connectors (which can be distinguished from one another) which are paired with these first connectors, respectively.

At least with respect to the first connector which is one of the female and male connectors, it is not necessary to exchange a mold for each first connector in order to form the first fitting member at a different position. And besides, it is not necessary to prepare a plurality of kinds of molds for respectively forming different kinds of first connectors. Therefore, the time, required for producing the female and male connectors, is reduced, and the number of the component parts and the number of the molds, used in the production of the female and male connectors, are reduced, so that the production cost of the female and male connectors can be reduced.

According to the present invention, the adapter mounting hole as well as the mounting portion of the adapter is formed into the regular polygonal shape, and utilizing this regular polygonal shape, the adapter, rotated into a selected one of the predetermined angular positions arranged with the fixed interval, can be attached to the housing with the simple construction. Therefore, the operation for setting the adapter to the selected angle can be carried out easily, so that the production cost can be further reduced.

According to the present invention, when the first adapter is placed at the selected angular position, and is attached to the first housing, the first fitting member is placed in a position corresponding to the second fitting member. When the female and male connectors are moved toward each other so as to be fitted together, the convex portion is fitted into the groove, thereby allowing the female and male connectors to be fitted together. On the other hand, when the first adapter is placed in other angular position than the selected angular position, and is attached to the first housing, the convex portion interferes with other portion of the first adapter than the groove, so that the female and male connectors can not be fitted together. Thus, with this simple construction, only when the first adapter is placed at the selected angular position, and is attached to the first housing, the female and male connectors are allowed to be fitted together, so that the production cost can be further reduced.

According to the present invention, the second adapter can be rotated to be placed at any of the plurality of predetermined angular positions arranged with the fixed interval, and can be attached to the second housing. With respect to each mating pair of female and male connectors, the first and second adapters can be attached respectively to the first and second housings in such a manner that the first and second adapters are placed at their selected angular position. Therefore, using the common first adapter and second adapters, there can be provided a plurality of female and male connectors which can be distinguished from one another.

Therefore, with respect to the female and male connectors, it is not necessary to exchange a mold for each connector in order to form the first fitting member or the second fitting member at a different position. And besides, with respect to the female and male connectors, it is not necessary to prepare a plurality of kinds of molds for respectively forming different kinds of connectors. Therefore, the time, required for producing the female and male connectors, is reduced, and the number of the component parts and the number of the molds, used in the production of the female and male connectors, are further reduced, so that the production cost of the female and male connectors can be further reduced.

According to the present invention, the second adapter mounting hole is formed into the regular polygonal shape similar to the shape of the first adapter mounting hole, and also the mounting portion of the second adapter is formed into the regular polygonal shape corresponding to the shape of the second adapter mounting hole, and utilizing this polygonal shape, the first and second adapters can be positively set to the same angle with the simple construction, and therefore the production cost can be further reduced.

According to the present invention, there can be provided the female-male connector-fitting structure in which a mating pair of female and male connectors can be easily recognized, thereby preventing the erroneous fitting of the female and male connectors, and also the production cost can be reduced.

DETAIL DESCRIPTION OF PREFERRED EMBODIMENT

A preferred embodiment of the present invention will now be described in detail with reference to the drawings.

First Embodiment

Figure 1:
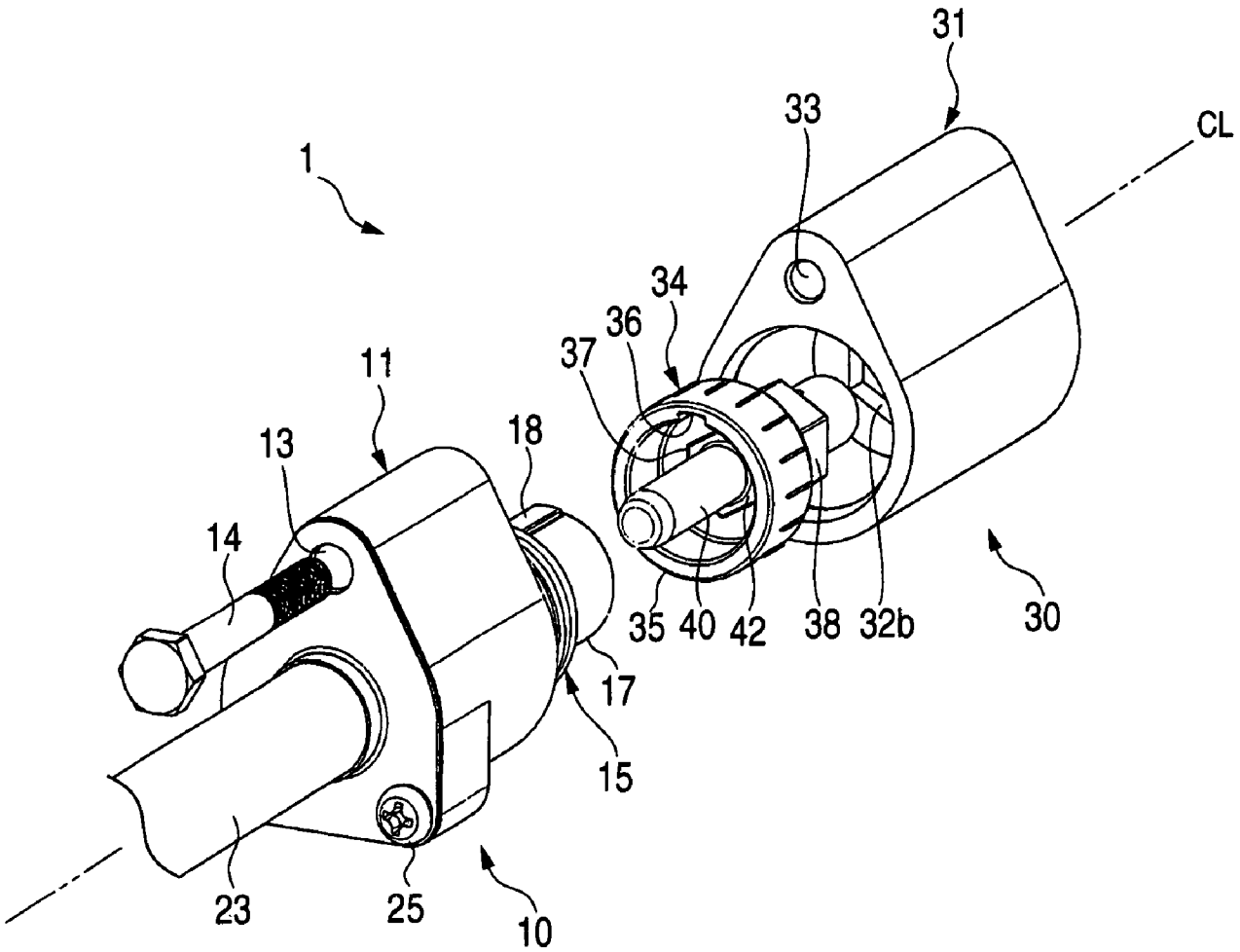
FIG. 1 is a perspective view of a first embodiment of a female-male connector-fitting structure of the present invention, showing its appearance.
Figure 2:
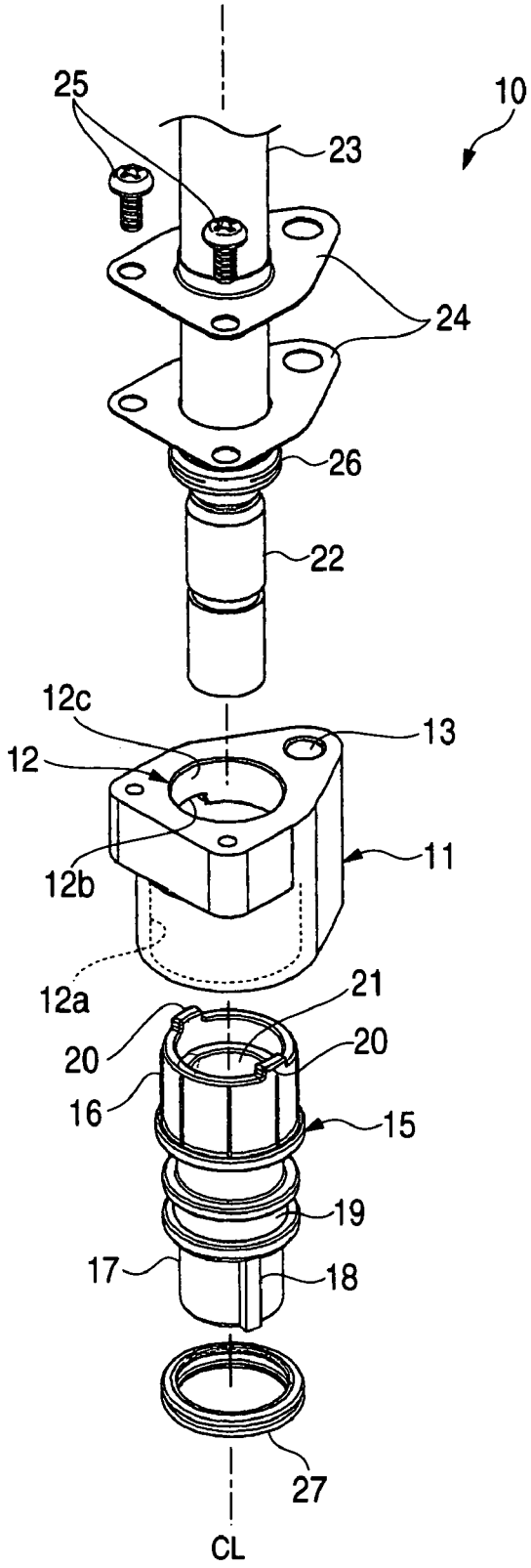
FIG. 2 is an exploded, perspective view of a male connector shown in FIG. 1.
Figure 3A:
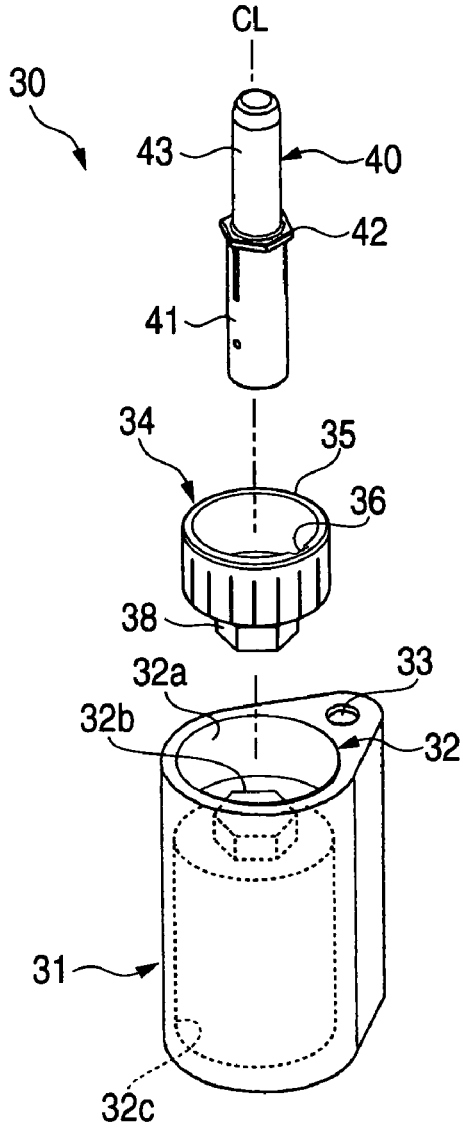
FIG. 3A is an exploded, perspective view of a female connector shown in FIG. 1.
Figure 3B:
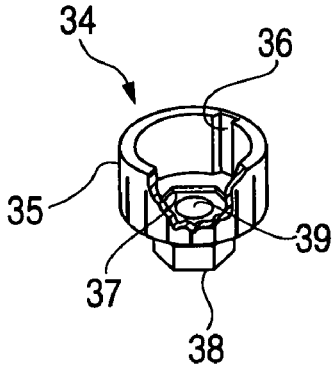
FIG. 3B is a partly-broken perspective view of a female adapter shown in FIG. 3A.

FIG. 1 is a perspective view of a first embodiment of a female-male connector-fitting structure of the invention, showing its appearance, FIG. 2 is an exploded, perspective view of a male connector shown in FIG. 1, FIG. 3A is an exploded, perspective view of a female connector shown in FIG. 1, FIG. 3B is a partly-broken perspective view of a female adapter shown in FIG. 3A, and FIGS. 4A to 4C are perspective explanatory views of the manner of attaching the female adapter when forming a plurality of pairs of female and male connectors.

As shown in FIGS. 1 to 3B, the female-male connector-fitting structure 1 is a structure for fitting the female connector 30 and the male connector 10 together, and this fitting structure 1 is used for connecting a wire (or cable) 23 such as a shielded wire to an electrical equipment or a wire. An axis CL, shown in FIGS. 1 to 3B, is an axis serving as a reference when fitting the male and female connectors 10 and 30 together.

First, the structure of the male connector 10 will be described with reference to FIGS. 1 and 2. The male connector 10 comprises a male housing 11, a male inner housing 15 fixed to the male housing 11, and a male terminal 22 for connection to a female terminal 40 of the female connector 30 (described later).

The male terminal 22 is fixed to a distal end portion of the wire 23, and is electrically connected to a conductor (not shown) of the wire 23. A seal member 26 such as an O-ring is mounted on the wire 23, and is placed near to the male terminal 22.

The male inner housing 15 is a generally cylindrical member, and a terminal receiving hole 21 for receiving the male terminal 22 in such a manner that an axis of the male terminal 22 coincides with an axis of the male inner housing 15 is formed through the male inner housing 15, and extends on and along the axis of the male inner housing 15. A fitting portion 17 for fitting on the female adapter 34 (described later) is formed at one end portion (hereinafter referred to as "distal end portion" of the male inner housing 15) of the male inner housing 15 which is placed at a distal end side of the male terminal 22 when the male terminal 22 is received in the terminal receiving hole 21. A guide rib (convex portion) 18 is formed on an outer peripheral surface of the fitting portion 17, and extends along the axis of the male inner housing 15.

A pair of projections 20 are formed on a peripheral edge of the other end portion 16 (hereinafter referred to as "proximal end portion" of the male inner housing 15) of the male inner housing 15, and project along the axis of the male inner housing 15. A seal groove 19 is formed at that portion of the male inner housing 15 placed intermediate the proximal end portion 16 and the fitting portion 17, and a seal member 27 such as an O-ring is fitted in this seal groove 19.

The male housing 11 is a pillar-shaped member having a generally spindle-shaped cross-section in a plane perpendicular to the axis CL, and a terminal passage hole 12 for the passage of the male terminal 22 therethrough is formed through the male housing 11, and extends on and along the axis CL. A bolt passage hole 13 is formed through the male housing 11, and extends parallel to the terminal passage hole 12 in adjoining relation thereto. A bolt 14, serving as fixing means for fixing the female and male connectors to each other in the fixed condition, is passed through the bolt passage hole 13.

An insertion port 12*c* for the insertion of the male terminal 22 therein is provided at one end of the terminal passage hole 12, and the insertion port 12*c* has such an inner diameter that the seal member 26, mounted on the wire 23, can be held in closely contact with an inner surface of the insertion port 12*c*. A receiving portion 12*a* for receiving the proximal end portion 16 is provided at the other end portion of the terminal passage hole 12, and communicates with the insertion port 12*c*, and is open to the other end of the terminal passage hole 12. An inner diameter of the receiving portion 12*a* is equal to or slightly larger than an outer diameter of the proximal end portion 16, and is larger than the inner diameter of the insertion port 12*c*. The male inner housing 15 is held in the male housing 11, with the proximal end portion 16 fitted in the receiving portion 12*a*, in such a manner that the axis of the male inner housing 15 coincides with the axis CL.

Engagement grooves 12*b* for engagement respectively with the projections 20 formed on the proximal end portion 16 are formed in a step portion formed at the boundary between the insertion port 12*c* and the receiving portion 12*a*. When the proximal end portion 16 of the male inner housing 15 is inserted into the receiving portion 12*a* of the terminal passage hole 12, the projections 20 are engaged respectively in the engagement grooves 12*b*, thereby preventing the male inner housing 15 from rotating relative to the male housing 11 about the axis CL.

Here, a procedure of assembling the male connector 10 of the above construction will be described.

First, the wire 23 is passed through two mounting plates 24, and the male terminal 22 is fixed to the distal end portion of the wire 23. Then, the male terminal 22 is inserted into the terminal passage hole 12 of the male housing 11 through the insertion port 12*c*. The seal member 26 on the wire 23 is held in closely contact with the inner surface of the insertion port 12*c*, and in this condition the mounting plates 24 are fastened to the male housing 11 by screws 25, thereby fixing the male terminal 22 and the wire 23 to the male housing 11.

Then, the proximal end portion 16 of the male inner housing 15 is inserted into the receiving portion 12*a* of the terminal passage hole 12, while inserting the male terminal 22 into the terminal receiving hole 21. The proximal end portion 16 is fitted in the receiving portion 12*a*, and also the projections 20, formed at the proximal end portion 16, are engaged respectively in the engagement grooves 12*b* in the inner surface of the terminal passage hole 12, thereby fixing the male inner housing 15 to the male housing 11, thus completing the assembling of the male connector 10.

Next, the structure of the female connector 30 will be described with reference to FIGS. 1 and 3B. The female connector 30 comprises a female housing 31, the female adapter 34 which is attached to the female housing 31, and can be fitted on the fitting portion 17 of the male connector 10, and the female terminal 40 for connection to the male terminal 22 of the male connector 10.

The female terminal 40 is electrically connected to a wire, a circuit of an electrical equipment or other (not shown), and this female terminal 40 can be electrically connected to the male terminal 22 of the male connector 10, with its distal end portion 43 fitted on the male terminal 22. A rotation prevention portion 42 of a hexagonal shape is formed on the female terminal 40, and is placed between the proximal end portion 41 and a distal end portion 43.

The female adapter 34 includes a hood portion 35 of a generally hollow cylindrical shape for fitting on the fitting portion 17 of the male inner housing 15, and a mounting portion 38 having a regular hexagonal cross-sectional shape in a plane perpendicular to an axis of the hood portion 35. An axis of the mounting portion 38 coincides with the axis of the hood portion 35. A guide groove 36 for engagement with the guide rib 18 of the male inner housing 15 is formed in an inner surface of the hood portion 35, and extends along the axis thereof. A terminal holding hole 39 for holding the female terminal 40 in such a manner that the axis of the female terminal 40 coincides with the axis of the hood portion 35 is formed in the mounting portion 38. Also, a recess 37, having a hexagonal shape corresponding to the shape of the rotation prevention portion 42, is formed in the mounting portion 38, and can be fitted on the rotation prevention portion 42 to prevent the rotation of the female terminal 40.

The male housing 31 is a pillar-shaped member having a generally spindle-shaped cross-section in a plane perpendicular to the axis CL. This male housing 31 includes a female adapter receiving portion 32*a* which is open to one end of the female housing 31 so as to receive the hood portion 35 of the female adapter 34 in such a manner that the axis of the hood portion 35 of the female adapter 34 coincides with the axis CL. The male housing 31 also includes a female adapter mounting hole 32*b* which is continuous with the receiving portion 32*a* in the direction of the axis CL, and has a regular hexagonal cross-sectional shape (corresponding to the cross-sectional shape of the mounting portion 38 of the female adapter 34) in a plane perpendicular to the axis CL. When the hood portion 35 is received in the female adapter receiving portion 32*a*, the mounting portion 38 is fitted in the female adapter mounting hole 32*b*.

The female housing 31 further includes a terminal receiving chamber 32*c* which is continuous with the female adapter mounting hole 32*b* in the direction of the axis CL, and is open to the other end of the female housing 31. This terminal receiving portion 32*c* receives the proximal end portion 41 of the female terminal 40 projecting from the female adapter 34. The female housing 31 has a screw hole 33 having threads corresponding to threads of the bolt 14.

Here, a procedure of assembling the female connector 30 of the above construction will be described.

First, the proximal end portion 41 of the female terminal 40 is passed through the hood portion 35 of the female adapter 34, and is further passed through the terminal holding hole 39 in the mounting portion 38, so that the rotation prevention portion 42 of the female terminal 40 is fitted into the recess 37 in the mounting portion 38, thereby fixing the female terminal 40 to the female adapter 34.

Then, the hood portion 35 is received in the female adapter receiving portion 32*a* of the female housing 31, and also the mounting portion 38 of the female adapter 34 is fitted into the female adapter mounting hole 32*b* in the female housing 31, thereby attaching the female adapter 34 to the female housing 31.

When the mounting portion 38 of the female adapter 34 is to be fitted into the female adapter mounting hole 32*b*, the female adapter 34 is rotated about the axis CL to be placed at a selected one of a plurality of predetermined angular positions arranged with a fixed interval (In this embodiment, since the mounting portion 38 as well as the female adapter mounting hole 32*b* has the regular hexagonal cross-sectional shape, the predetermined angle is 60 degrees) so that the guide groove 36, formed in the hood portion 35, can be placed in correspondent with the guide rib 18 formed on the male inner housing 15, and thereafter the mounting portion 38 is fitted into the female adapter mounting hole 32*b*.

The wire or other (not shown) is electrically connected to the proximal end portion 41, and a seal is formed between the terminal receiving portion 32*c* of the female housing 31 and the proximal end portion 41 by a packing, a cap or the like (not shown), thus completing the assembling of the female connector 30.

Figure 4A:
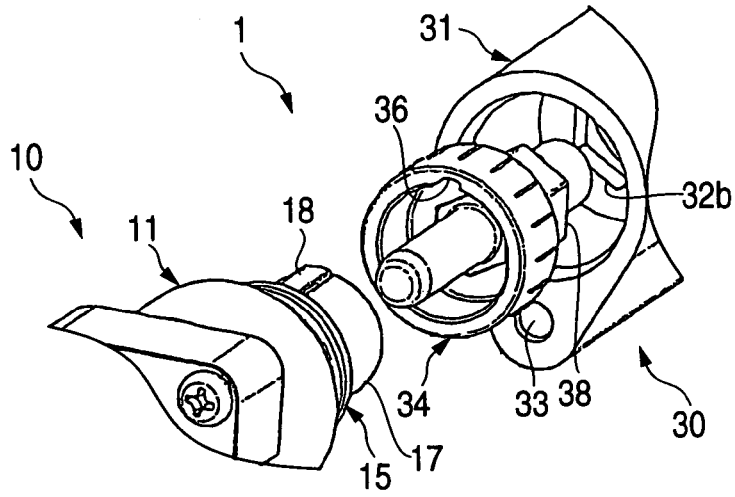
FIGS. 4A to 4C are perspective explanatory views of the manner of attaching the female adapter when forming a plurality of pairs of female and male connectors in the female-male connector-fitting structure of FIG. 1.

Next, in the female-male connector-fitting structure, the manner of attaching the female adapter 34 when providing a plurality of pairs of female and male connectors which can be recognized will be described with reference to FIGS. 4A to 4C. For convenience' sake, the condition of the female-male connector-fitting structure 1, shown in FIG. 4A, is used as a reference, and in this condition the angle of rotation of the guide rib 18 (formed on the suitable portion of the outer peripheral surface of the fitting portion 17) about the axis CL is 0 degree, and also the angle of rotation of the female adapter 34 relative to the female housing 31 about the axis CL is 0 degree.

Figure 4B:
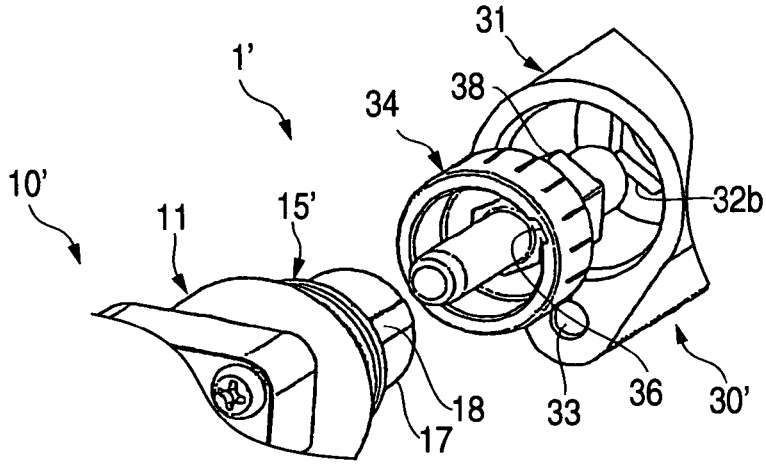
Figure 4C:
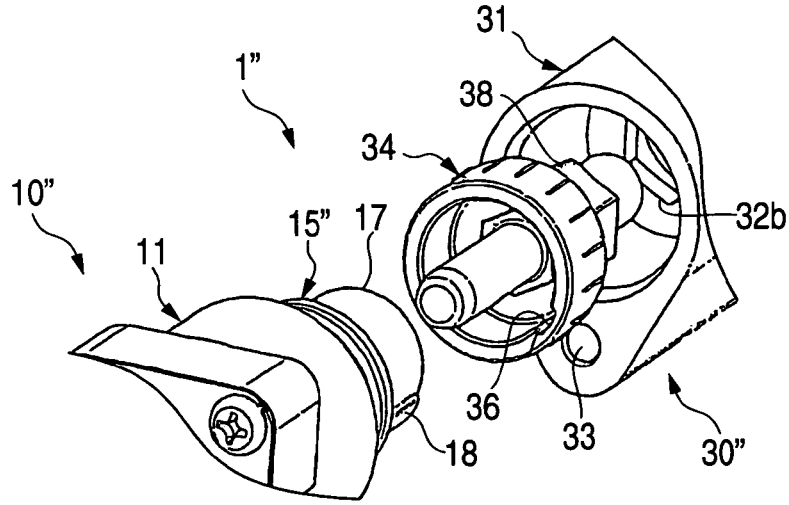

In a female-male connector-fitting structure 1' shown in FIG. 4B, a guide rib 18 of a male connector 15' is formed on that portion of an outer peripheral surface of a fitting portion 17 placed at a rotational angular position of 60 degrees. In a female-male connector-fitting structure 1" shown in FIG. 4C, a guide rib 18 of a male connector 15" is formed on that portion of an outer peripheral surface of a fitting portion 17 placed at a rotational angular position of 120 degrees.

Accordingly, the female adapter 34 is rotated about the axis CL to be placed at a selected one of the angular positions spaced 60 degrees from one another, and in this condition the mounting portion 38 is fitted into the female adapter mounting hole 32*b*, with the guide groove 36 displaced into a position corresponding to the guide rib 18 (that is, a position where the guide groove 36 can be engaged with the guide rib 18), thus attaching the female adapter 34 to the female housing 31. Namely, in the female-male connector-fitting structure 1 of FIG. 4A, the guide groove 36 is so placed as to be engaged with the guide rib 18, and therefore the female adapter 34 is rotated an angle of 0 degree about the axis CL, and is attached to the female housing 31. As a result, the guide groove 36 is placed so as to be engaged with the guide rib 18.

In the female-male connector-fitting structure 1' of FIG. 4B, the guide rib 18 is placed at the rotational angular position of 60 degrees. Therefore, the female adapter 34 is rotated 60 degrees about the axis CL from the condition shown in FIG. 4A, and is attached to the female housing 31. As a result, the guide groove 36 is so placed as to be engaged with the guide rib 18. In the female-male connector-fitting structure 1" of FIG. 4C, the guide rib 18 is placed at the rotational angular position of 120 degrees. Therefore, the female adapter 34 is rotated 120 degrees about the axis CL from the condition shown in FIG. 4A, and is attached to the female housing 31. As a result, the guide groove 36 is so placed as to be engaged with the guide rib 18.

When the mating pair of male and female connectors 10 and 30 are so placed as to be fitted together (that is, the bolt passage hole 13 in the male housing 11 is aligned with the screw hole 33 in the female housing 31, and also the male terminal 22 and the female terminal 40 are opposed to each other), the guide rib 18 on the male inner housing 15 is so placed as to be engaged in the guide groove 36 in the female adapter 34. Therefore, when the male connector 10 and the female connector 30 are to be fitted together, the fitting portion 17 is inserted into the hood portion 35 of the female adapter 34, with the guide rib 18 received in the guide groove 36, and also the bolt passage hole 13 is connected to the screw hole 33, and then the male housing 11 and the female housing 31 are fastened together by the bolt 14, so that the male connector 10 and the female connector 30 are fixed to each other in the fitted condition.

On the other hand, when for example, the male connector 10 and the female connector 30' which do not form the mating pair are so placed as to be fitted together, the guide rib 18 on the male inner housing 15 is placed out of correspondent with the guide groove 36 in the female adapter 34. Therefore, the fitting portion 17 of the male inner housing 15 can not be inserted into the hood portion 35 of the female adapter 34 since the guide rib 18 interferes with the hood portion 35 of the female adapter 34. And besides, when one of the male connector 10 and the female connector 30' is rotated about the axis CL so that the guide rib 18 on the male inner housing 15 and the guide groove 36 in the female adapter 34 can be brought into correspondent with each other, the bolt passage hole 13 will not be connected to the screw hole 33, and therefore the male housing 11 and the female housing 31 can not be fastened together by the bolt 14. Thus, among the plurality of pairs of female and male connectors, each mating pair of female and male connectors can be easily recognized, and the erroneous fitting of the female and male connectors is prevented.

In the above female-male connector-fitting structure 1, with respect to the plurality of kinds of male connectors 10, 10' and 10" having the respective guide ribs 18 formed respectively on those portions of their fitting portions 17 which are angularly spaced the predetermined angle from one another, the female adapter 34 is rotated into a selected one of the angular positions spaced the predetermined angle from one another, and is attached to the female housing 31 at this selected angle, so that the guide groove 36 in the female adapter 34 is rotated into the position corresponding to the guide rib 18 (that is, the position where the guide groove 36 can be engaged with the guide rib 18). Therefore, by using the common female adapter 34, there can be provided the plurality of kinds of male connectors 10, 10' and 10" and the plurality of kinds of female connectors 30, 30' and 30" (which can be distinguished from one another) which are paired with these male connectors, respectively.

Namely, with respect to the female connector 30, it is not necessary to exchange a mold for each connector in order to form the guide groove 36 at the position where the guide groove 36 can be engaged with the guide rib 18. And besides, it is not necessary to prepare a plurality of kinds of molds for respectively forming different kinds of female connectors. Therefore, the time, required for producing the female and male connectors, is reduced, and the number of the component parts and the number of the molds, used in the production of the female and male connectors, are reduced, so that the production cost of the female and male connectors can be reduced.

The female adapter mounting hole 32*b* as well as the mounting portion 38 of the female adapter 34 is formed into the regular hexagonal shape, and utilizing this regular hexagonal shape, the female adapter 34, rotated into a selected one of the predetermined angular positions arranged with the fixed interval, can be attached to the female housing 31 with the simple construction. Therefore, the operation for setting the female adapter to the selected angle can be carried out easily, so that the production cost can be further reduced.

After the male connector 10 is fitted into the female connector 30, the female and male connectors are fastened together by the bolt 14, and therefore the erroneous fitting of the female and male connectors which do not form the mating pair, as well as the insufficient fitting of the female and male connectors, can be easily confirmed.

Second Embodiment

Figure 5:
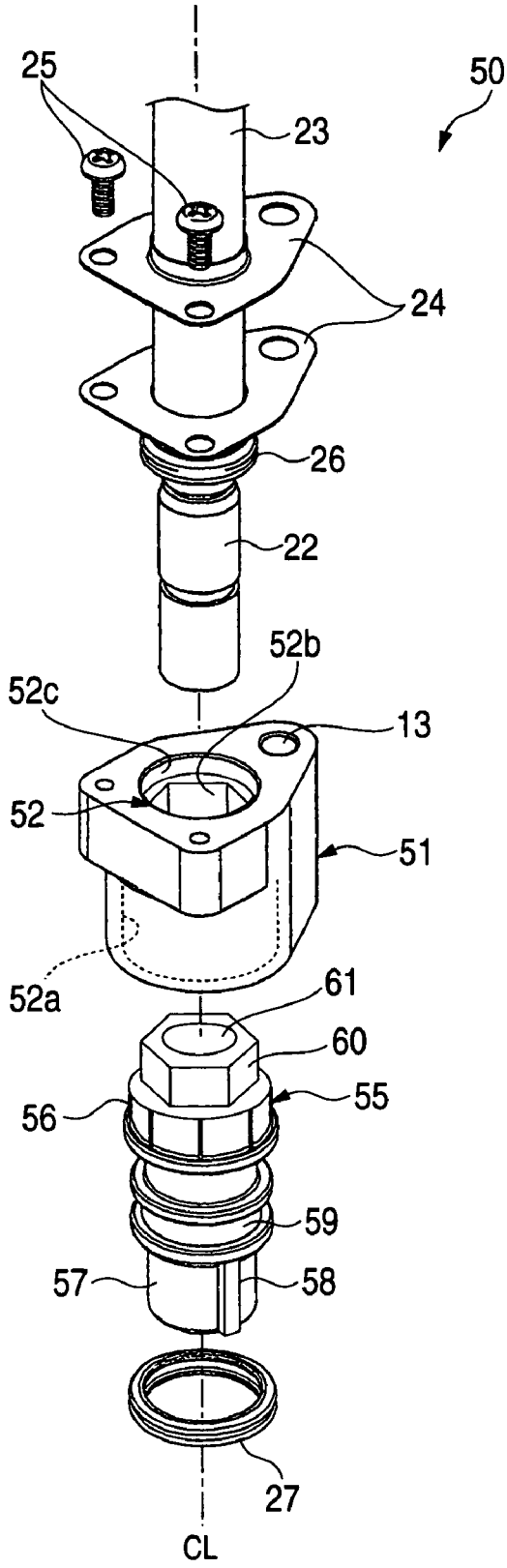
FIG. 5 is an exploded, perspective view of a male connector used in a second embodiment of a female-male connector-fitting structure of the invention.

Next, a second embodiment of a female-male connector-fitting structure of the invention will be described with reference to FIGS. 5 to 6C. FIG. 5 is an exploded, perspective view of a male connector of the female-male connector-fitting structure of the second embodiment, and FIGS. 6A to 6C are perspective explanatory views of the manner of attaching the male adapter and the female adapter when forming a plurality of pairs of female and male connectors. In the female-male connector-fitting structure 2 of this embodiment, the male inner housing 15 of the male connector 10 of the female-male connector-fitting structure 1 of the above first embodiment is so modified that it can be rotated relative to the male housing 11 to be placed at the selected one of a plurality predetermined angular positions arranged with the fixed interval, and is attached to the male housing 11. The other members are identical to those of the first embodiment, respectively, and therefore will be designated by identical reference numerals, respectively, and explanation thereof will be omitted.

As shown in FIG. 5, the male connector 50 of the female-male connector-fitting structure 2 of this embodiment comprises a male housing 51, the male adapter (second adapter) 55 attached to the male housing 51, and a male terminal 22 for connection to a female terminal 40 (see FIGS. 3A and 3B) of the female connector 30.

The male adapter 55 is a generally cylindrical member, and a terminal receiving hole 61 for receiving the male terminal 22 (in such a manner that an axis of the male terminal 22 coincides with an axis of the male adapter 55) is formed through the male adapter 55, and extends on and along the axis of the male adapter 55. A fitting portion 57 for fitting in a hood portion 35 (see FIGS. 3A and 3C) of the female adapter 34 is formed at one end portion (hereinafter referred to as "distal end portion" of the male adapter 55) of the male adapter 55 which is placed at a distal end side of the male terminal 22 when the male terminal 22 is received in the terminal receiving hole 61. A guide rib (convex portion) 58 is formed on an outer peripheral surface of the fitting portion 57, and extends along the axis of the male adapter 55.

A mounting portion 60, having a regular hexagonal cross-sectional shape in a plane perpendicular to the axis of the male adapter 55, is formed at an extremity of the other end portion 56 (hereinafter referred to as "proximal end portion" of the male adapter 55) of the male adapter 55. A seal groove 59 is formed at that portion of the male adapter 55 placed intermediate the proximal end portion 56 and the fitting portion 57, and a seal member 27 is fitted in this seal groove 59.

The male housing 51 is a pillar-shaped member having a generally spindle-shaped cross-section in a plane perpendicular to an axis CL, and a terminal passage hole 52 for the passage of the male terminal 22 therethrough is formed through the male housing 51, and extends on and along the axis CL. A bolt passage hole 13 is formed through the male housing 51, and extends parallel to the terminal passage hole 52 in adjoining relation thereto. A bolt 14, serving as fixing means for fixing the female and male connectors to each other in the fixed condition, is passed through the bolt passage hole 13.

An insertion port 52*c* for the insertion of the male terminal 22 therein is provided at one end of the terminal passage hole 52, and the insertion port 52*c* has such an inner diameter that a seal member 26, mounted on a wire 23, can be held in closely contact with an inner surface of the insertion port 52*c*. A male adapter receiving portion 52*a* for receiving the proximal end portion 56 of the male adapter 55 is provided at the other end portion of the terminal passage hole 52, and communicates with the insertion port 12*c*, and is open to the other end of the terminal passage hole 52. A male adapter mounting hole 52*b*, having a regular hexagonal cross-sectional shape (corresponding to the cross-sectional shape of the mounting portion 60 of the male adapter 55) in a plane perpendicular to the axis CL, is also provided at the other end portion of the terminal passage hole 52, and the male adapter receiving portion 52*a* and the insertion port 52*c* communicate with each other via the male adapter mounting hole 52*b*. An inner diameter of the male adapter receiving portion 52*a* is slightly larger than an outer diameter of the proximal end portion 56 of the male adapter 55. The male adapter 55 is attached to the male housing 51, with the proximal end portion 56 fitted in the male adapter receiving portion 52*a* and also with the mounting portion 60 fitted in the male adapter mounting hole 52*b*, in such a manner that the axis of the male adapter 55 coincides with the axis CL.

Here, a procedure of assembling the male connector 50 of the above construction will be described.

First, the wire 23 is passed through two mounting plates 24, and the male terminal 22 is fixed to a distal end portion of the wire 23. Then, the male terminal 22 is inserted into the terminal passage hole 52 of the male housing 51 through the insertion port 52*c*. The seal member 26 on the wire 23 is held in closely contact with the inner surface of the insertion port 52*c*, and in this condition the mounting plates 24 are fastened to the male housing 51 by screws 25, thereby fixing the male terminal 22 and the wire 23 to the male housing 51.

Then, the proximal end portion 56 of the male adapter 55 is inserted into the male adapter receiving portion 52*a* of the terminal passage hole 52, while inserting the male terminal 22 into the terminal receiving hole 61. The proximal end portion 56 of the male adapter 55 is fitted in the male adapter receiving portion 52*a*, and also the mounting portion 60, formed at the proximal end portion 56, is fitted in the male adapter mounting hole 52*b* of the terminal passage hole 52, so that the male adapter 55 is attached to the male housing 51, thus completing the assembling of the male connector 50.

When the mounting portion 60 of the male adapter 55 is to be fitted into the male adapter mounting hole 52*b*, the male adapter 55 is rotated about the axis CL to be placed at a selected one of the plurality predetermined angular positions arranged with the fixed interval (In this embodiment, since the mounting portion 60 as well as the male adapter mounting hole 52*b* has the regular hexagonal cross-sectional shape, the predetermined angle is 60 degrees) so that the guide rib 58, formed on the fitting portion 57 of the male adapter 55, can be placed in correspondent with a guide groove 36 formed in the hood portion 35 of the female adapter 34, and thereafter the mounting portion 60 is fitted into the male adapter mounting hole 52*b*.

The other construction is similar to that of the female-male connector-fitting structure 1 of the above first embodiment, and therefore explanation thereof will be omitted here.

Next, in the female-male connector-fitting structure of this embodiment, the manner of attaching the male connector 55 and the female adapter 34 when providing a plurality of pairs of female and male connectors which can be easily recognized will be described with reference to FIGS. 6A to 6C. For convenience' sake, the condition of the female-male connector-fitting structure 2, shown in FIG. 6A, is used as a reference, and in this condition the angle of rotation of the male adapter 55 relative to the male housing 51 about the axis CL is 0 degree, and also the angle of rotation of the female adapter 34 relative to the female housing 31 about the axis CL is 0 degree.

The male adapter 55 is rotated about the axis CL to be placed at a selected one of the angular positions spaced 60 degrees from one another, and in this condition the male adapter 55 is attached to the male housing 51, with the mounting portion 60 fitted in the male adapter mounting hole 52*b*. Namely, in a female-male connector-fitting structure 2' of FIG. 6B, the male adapter 55 is rotated 60 degrees about the axis CL from the condition shown in FIG. 6A, and is attached to the male housing 51. In a female-male connector-fitting structure 2" of FIG. 6C, the male adapter 55 is rotated 120 degrees about the axis CL from the condition shown in FIG. 6A, and is attached to the male housing 51.

Therefore, the guide rib 58 on the male adapter 55 of the male connector 50 is placed at the reference position (that is, at the rotational angular position of 0 degree). In the male connector 50' shown in FIG. 6B, the guide rib 58 is placed at a rotational angular position of 60 degrees. In the male connector 50" shown in FIG. 6C, the guide rib 58 is placed at a rotational angular position of 120 degrees. Thus, the position of the guide rib 58 relative to the bolt passage hole (fixing means) 13 in the male housing 51 can be varied according to the angle of rotation of the male adapter 55.

Accordingly, the female adapter 34 is rotated about the axis CL to be placed at a selected one of the angular positions spaced 60 degrees from one another, and in this condition a mounting portion 38 is fitted into a female adapter mounting hole 32*b*, with the guide groove 36 rotated into a position corresponding to the guide rib 58 (that is, a position where the guide groove 36 can be engaged with the guide rib 58), thus attaching the female adapter 34 to the female housing 31. Namely, in the female-male connector-fitting structure 2 of FIG. 6A, the guide groove 36 is so placed as to be engaged with the guide rib 58, and therefore the female adapter 34 is rotated an angle of 0 degree about the axis CL, and is attached to the female housing 31. As a result, the guide groove 36 is so placed as to be engaged with the guide rib 58.

Figure 6A:
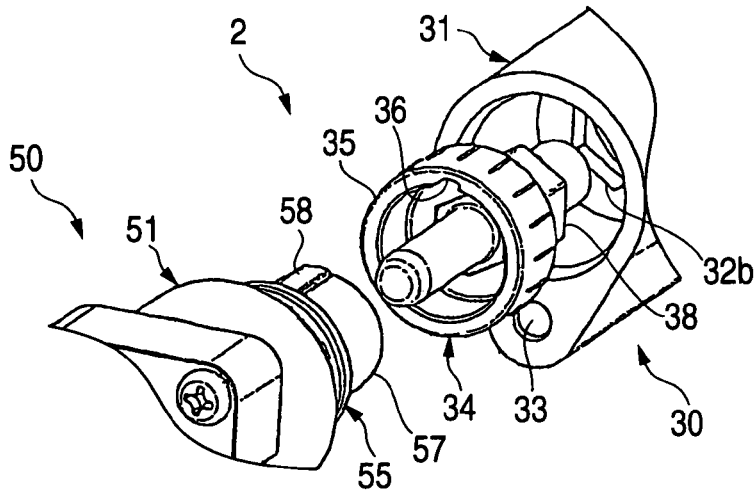
FIGS. 6A to 6C are perspective explanatory views of the manner of attaching the male adapter and the female adapter when forming a plurality of pairs of female and male connectors in the female-male connector-fitting structure of the second embodiment.
Figure 6B:
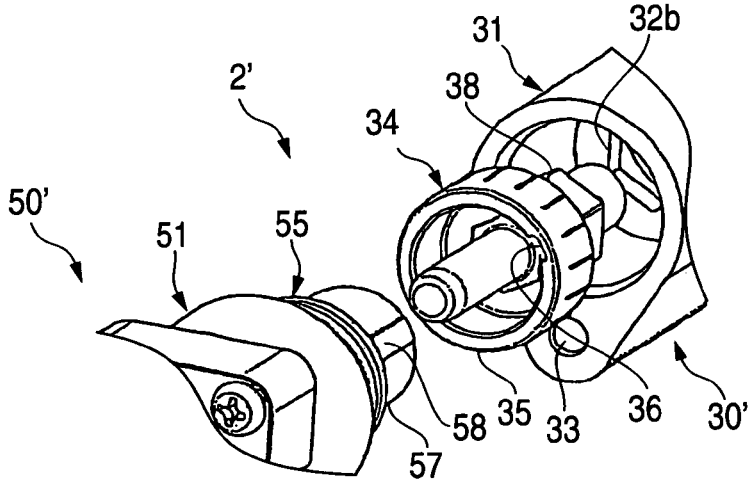
Figure 6C:
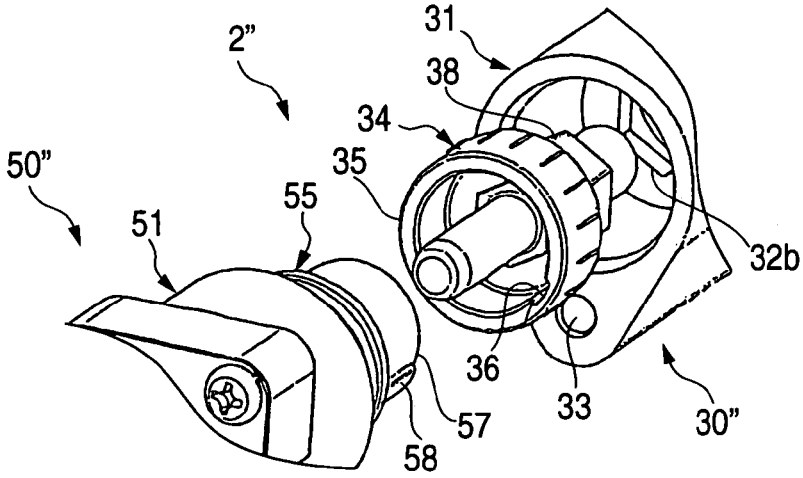
Figure 7A:
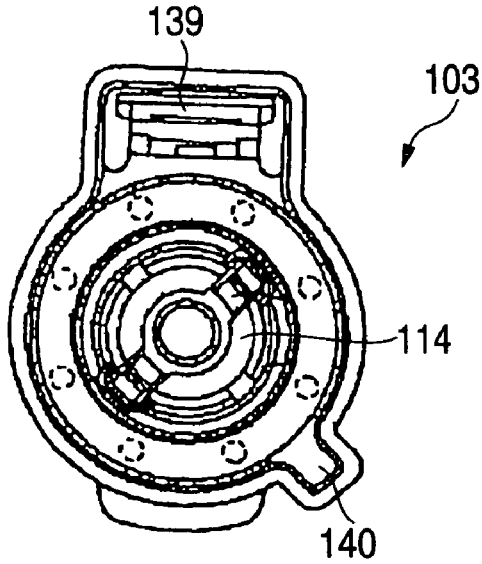
FIG. 7A is a front-elevational view of a related female connector.
Figure 7B:
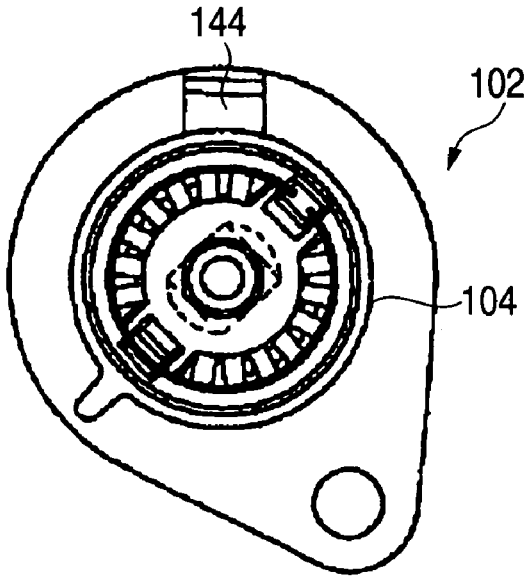
FIG. 7B is a front-elevational view of a related male connector.
Figure 8:
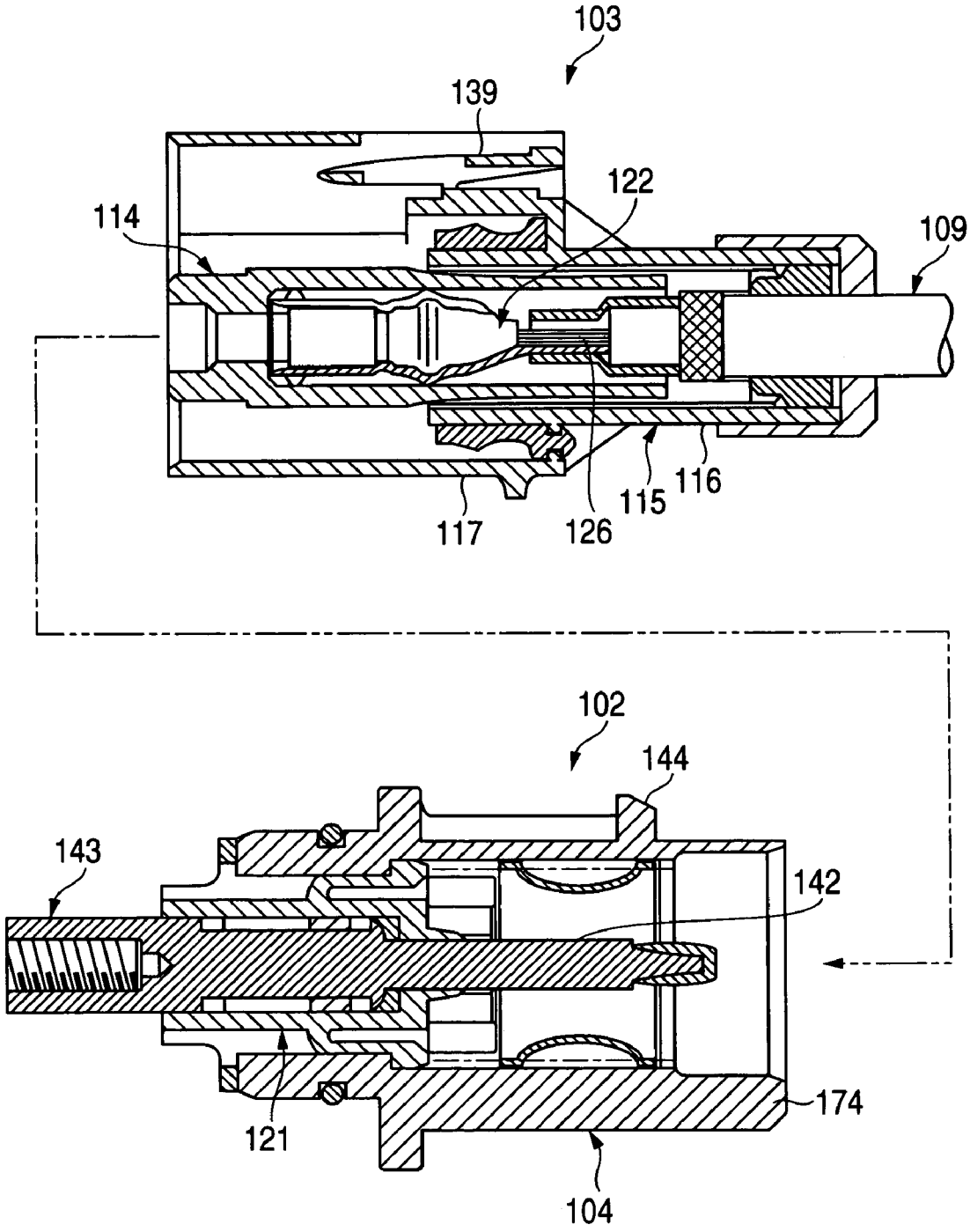
FIG. 8 is a cross-sectional view showing the male connector and the female connector shown in FIGS. 7A and 7B.

In the female-male connector-fitting structure 2' of FIG. 6B, the guide rib 58 is placed at the rotational angular position of 60 degrees, and therefore the female adapter 34 is rotated 60 degrees about the axis CL from the condition shown in FIG. 6A, and is attached to the female housing 31. As a result, the guide groove 36 is so placed as to be engaged with the guide rib 58. In the female-male connector-fitting structure 2" of FIG. 6C, the guide rib 58 is placed at the rotational angular position of 120 degrees, and therefore the female adapter 34 is rotated 120 degrees about the axis CL from the condition shown in FIG. 6A, and is attached to the female housing 31. As a result, the guide groove 36 is so placed as to be engaged with the guide rib 58.

When the mating pair of male and female connectors 50 and 30 are so placed as to be fitted together (that is, the bolt passage hole 13 in the male housing 51 is aligned with a screw hole 33 in the female housing 31, and also the male terminal 22 and the female terminal 40 are opposed to each other), the guide rib 58 on the male inner housing 55 is so placed as to be engaged in the guide groove 36 in the female adapter 34. Therefore, when the male connector 50 and the female connector 30 are to be fitted together, the fitting portion 57 is inserted into the hood portion 35 of the female adapter 34, with the guide rib 58 received in the guide groove 36, and also the bolt passage hole 13 is connected to the screw hole 33, and then the male housing 51 and the female housing 31 are fastened together by the bolt 14, so that the male connector 50 and the female connector 30 are fixed to each other in the fitted condition.

On the other hand, when for example, the male connector 50 and the female connector 30' which do not form the mating pair are so placed as to be fitted together, the guide rib 58 on the male inner housing 55 is placed out of correspondent with the guide groove 36 in the female adapter 34. Therefore, the fitting portion 57 of the male inner housing 55 can not be inserted into the hood portion 35 of the female adapter 34 since the guide rib 58 interferes with the hood portion 35 of the female adapter 34. And besides, when one of the male connector 50 and the female connector 30' is rotated about the axis CL so that the guide rib 58 on the male inner housing 55 and the guide groove 36 in the female adapter 34 can be brought into correspondent with each other, the bolt passage hole 13 will not be connected to the screw hole 33, and therefore the male housing 51 and the female housing 31 can not be fastened together by the bolt 14. Thus, among the plurality of pairs of female and male connectors, each mating pair of female and male connectors can be easily recognized, and the erroneous fitting of the female and male connectors is prevented.

In the above female-male connector-fitting structure 2, with respect to each mating pair of female and male connectors, the male adapter and the female connector are attached respectively to the male housing 51 and the female housing 31 at the predetermined angle, and by doing so the position of the guide rib 58 relative to the bolt passage hole (fixing means) 13, as well as the position of the guide groove 36 relative to the screw hole (fixing means) 33, can be changed while maintaining such positional relation between the guide rib 58 and the guide groove 36 that the two can be engaged with each other.

Therefore, by using the various common parts, there can be provided the plurality of pairs of female and male connectors which can be distinguished from one another, and it is not necessary to exchange a mold for each male connector 50 and a mold for each female connector 30 in order to form the guide rib 58 and the guide groove 36 at the respective predetermined positions as in the related structure so that each mating pair of female and male connectors can be recognized. And besides, it is not necessary to prepare a plurality of kinds of molds for the female and male connectors. Therefore, the time, required for producing the female and male connectors, is reduced, and the number of the component parts and the number of the molds, used in the production of the female and male connectors, can be further reduced, so that the production cost of the female and male connectors can be further reduced.

The male adapter mounting hole 52*b* is formed into the regular polygonal shape similar to the shape of the female adapter mounting hole 32*b*, and also the mounting portion 60 of the male adapter 55 is formed into the regular polygonal shape corresponding to the shape of the male adapter mounting hole 52*b*, and utilizing this hexagonal shape, the male adapter 55 and the female adapter 34 can be positively set to the same angle with the simple construction, and therefore the production cost can be further reduced.

The other effects and advantages are similar to those of the female-male connector-fitting structure 1 of the above first embodiment.

The present invention is not limited to the above embodiments, and suitable modifications, improvements and so on can be made. The shape, dimensions, numerical values, form, number, disposition, etc., of each of the constituent elements of the above embodiments are arbitrary, and are not limited in so far as the invention can be achieved.

For example, in each of the above embodiments, the female adapter mounting hole 32*b* and the mounting portion 38 of the female adapter 34, as well as the male adapter mounting hole 52*b* and the mounting portion 60 of the male adapter 55, are formed into the regular hexagonal shape so that the female adapter 34 as well as the male adapter 55 can be rotated to be placed at a selected one of the six angular positions (of 0 degrees, 60 degrees, 120 degrees, 180 degrees, 240 degrees and 300 degrees) spaced 60 degrees from one another, and can be attached respectively to the female housing 31 and the male housing 51. However, the female adapter mounting hole 32*b* and the mounting portion 38 of the female adapter 34, as well as the male adapter mounting hole 52*b* and the mounting portion 60 of the male adapter 55, can be formed into the shape of a regular polygon having a larger number of angles than a hexagon. By doing so, there can be set the same number of angular positions as the number of the angles of the polygon, and by using one kind of female and male adapters, the same number of pairs of female and male connectors (which can be distinguished from one another) as the number of the angles can be provided.

What is claimed is:

1. A connector comprising:

a first housing formed with a first fixing hole through which a fixing member passes and adapted to be fitted with a second housing along a fitting axis, the second housing formed with a second fixing hole which is aligned with the first fixing hole and through which the fixing member passes, the first and second holes extending parallel to the fitting axis; and a adapter provided on the first housing so as to be rotatable relative to the first housing about the fitting axis, the adapter provided with a first fitting member that is adapted to be fitted with a second fitting member provided in the second housing, so that the first fitting member is selectably placed in one of a plurality of predetermined angular positions relative to the fitting axis in accordance with the rotation of the adapter.

2. A connector according to claim 1, wherein one of the first and second fitting members is a groove extending in a direction of the fitting axis, and the other fitting member is a convex portion corresponding to the groove.

3. A connector according to claim 1, wherein the plurality of predetermined angular positions are arranged with a fixed interval.

4. A connector according to claim 3, wherein the first housing includes a first mounting hole that has a regular polygonal shape, the adapter is formed with a first mounting portion corresponding to the first mounting hole, and the first mounting portion is fitted with the first mounting hole.

5. A structure comprising:

a plurality of connectors, each of which comprises:

a first housing and a second housing adapted to be fitted with each other along a fitting axis, the first housing formed with a first fixing hole through which a fixing member passes, the second housing formed with a second fixing hole which is aligned with the first fixing hole and through which the fixing member passes, the first and second dholes extending parallel to the fitting axis; and a first adapter provided on the first housing so as to be rotatable relative to the first housing about the fitting axis, the first adapter provided with a first fitting member that is adapted to be fitted with a second fitting member provided in the second housing, so that the first fitting member is selectably placed in one of a plurality of predetermined angular positions relative to the fitting axis in accordance with the rotation of the first adapter, wherein the predetermined angular positions of the first fitting members in at least two of the connectors are different from each other.

6. A structure according to claim 5, wherein the second housing is provided with a second adapter having the second fitting member, and provided on the second housing so as to be rotatable relative to the second housing about the fitting axis.

7. A structure according to claim 6, wherein the second housing includes a second mounting hole that has a regular polygonal shape, the second adapter is formed with a second mounting portion corresponding to the second mounting hole, and the second mounting portion is fitted with the second mounting hole.

8. A method of fitting connectors comprising:

providing a plurality of connectors, each of which comprises:

a first housing and a second housing adapted to be fitted with each other along a fitting axis, the first housing formed with a first fixing hole through which a fixing member passes, the second housing formed with a second fixing hole through which the fixing member passes, the first and second holes extending parallel to the fitting axis; and a first adapter provided on the first housing so as to be rotatable relative to the first housing about the fitting axis, the first adapter provided with a first fitting member that is adapted to be fitted with a second fitting member provided in the second housing, so that the first fitting member is selectably placed in one of a plurality of predetermined angular positions relative, to the fitting axis in accordance with the rotation of the first adapter;

placing the second housings such that angular positions of the second fitting members relative to the fitting axis in at least two of the connectors are different from each other and the second fixing holes is aligned with the first fixing holes, respectively;

rotating the first adapters such that the angular positions of the first fitting members correspond to the angular positions of the second fitting members, respectively;

fitting the first fitting members with the second fitting members, respectively; and fixing the first housings to the second housings by the fixing members, respectively.

* * * * *